US009176456B2

(12) United States Patent
Tsuji et al.

(10) Patent No.: US 9,176,456 B2
(45) Date of Patent: Nov. 3, 2015

(54) IMAGE FORMING UNIT AND IMAGE FORMING APPARATUS COMPRISING FIRST PROCESS ROLLER AND SECOND PROCESS ROLLER

(71) Applicant: KYOCERA Document Solutions Inc., Osaka (JP)

(72) Inventors: Hirofumi Tsuji, Osaka (JP); Mitsuhiro Goda, Osaka (JP)

(73) Assignee: KYOCERA DOCUMENT SOLUTIONS INC., Osaka (JO)

( * ) Notice: Subject to any disclaimer, the term of this patent is extended or adjusted under 35 U.S.C. 154(b) by 0 days.

(21) Appl. No.: 14/447,280

(22) Filed: Jul. 30, 2014

(65) Prior Publication Data

US 2015/0043940 A1 Feb. 12, 2015

(30) Foreign Application Priority Data

Aug. 9, 2013 (JP) ..... 2013-166071
Sep. 12, 2013 (JP) ..... 2013-189390

(51) Int. Cl.
*G03G 15/02* (2006.01)
*G03G 21/00* (2006.01)

(52) U.S. Cl.
CPC ..... *G03G 21/0058* (2013.01); *G03G 15/0225* (2013.01)

(58) Field of Classification Search
CPC ..... G03G 15/0225
USPC ..... 399/176
See application file for complete search history.

(56) References Cited

U.S. PATENT DOCUMENTS

| | | | |
|---|---|---|---|
| 5,596,395 | A | 1/1997 | Sawamura et al. |
| 5,697,020 | A * | 12/1997 | Sato et al. |
| 7,415,225 | B2 * | 8/2008 | Inada |
| 7,702,254 | B2 * | 4/2010 | Matsubara et al. |
| 7,778,566 | B2 | 8/2010 | Fukuta et al. |
| 8,761,635 | B2 * | 6/2014 | Lee et al. |
| 2006/0285872 | A1 | 12/2006 | Fukuta et al. |
| 2007/0183809 | A1 | 8/2007 | Ishikawa |
| 2007/0292158 | A1 | 12/2007 | Matsumoto et al. |
| 2011/0069989 | A1 | 3/2011 | Kim |

FOREIGN PATENT DOCUMENTS

| | | |
|---|---|---|
| AT | 403892 | 8/2008 |
| EP | 1736836 A1 | 12/2006 |

(Continued)

OTHER PUBLICATIONS

The extended European search report issued by European Patent Office on Feb. 16, 2015 in the corresponding European patent application No. 14179220.0—7 pages.

*Primary Examiner* — Walter L Lindsay, Jr.
*Assistant Examiner* — Milton Gonzalez
(74) *Attorney, Agent, or Firm* — Knobbe, Martens, Olson & Bear LLP

(57) ABSTRACT

An image forming unit includes a charging roller, a cleaning roller, a bush member, and a shifting mechanism. A first journal portion of the bush member allows the charging roller to shift in a direction of abutment against and separation from a photosensitive drum and journals the charging roller with play in the direction of abutment and separation when the charging roller is free from nip with the photosensitive drum. When the charging roller forms a nip with the photosensitive drum by the movement of the bush member actuated by the shifting mechanism, the first journal portion journals the charging roller so that the charging roller is pressed by the photosensitive drum to shift to a position within the first journal portion close to the cleaning roller.

8 Claims, 11 Drawing Sheets

(56) References Cited

FOREIGN PATENT DOCUMENTS

| | | | |
|---|---|---|---|
| EP | 1736836 | B1 | 8/2008 |
| JP | 2006251573 | A * | 9/2006 |
| JP | 2006-267399 | | 10/2006 |
| JP | 2007-001680 | | 1/2007 |
| JP | 2008-151867 | | 7/2008 |
| JP | 4475179 | | 6/2010 |
| JP | 5049575 | | 10/2012 |

* cited by examiner

IMAGE FORMING UNIT AND IMAGE FORMING APPARATUS COMPRISING FIRST PROCESS ROLLER AND SECOND PROCESS ROLLER

INCORPORATION BY REFERENCE

This application claims priority to Japanese Patent Application No. 2013-166071 filed on Aug. 9, 2013, and Japanese Patent Application No. 2013-189390 filed on Sep. 12, 2013, the entire disclosure of which are incorporated herein by reference.

BACKGROUND

The present disclosure relates to an image forming unit and an image forming apparatus with the same and particularly relates to a mechanism for pressing a process roller against an object and drawing it back from the object.

An electrophotographic image forming apparatus forms an image by electrically charging the surface of a photosensitive drum at a nip with a charging roller, subjecting the charged surface of the photosensitive drum to light exposure and development to form a toner image, transferring the toner image to a recording paper sheet, and fixing it on the recording paper sheet. Despite recent demands for longer product life, in the image forming apparatus having the above structure, deterioration of the charging roller due to contamination may cause reduced product life.

To cope with the above problem, a mechanism is proposed for preventing contamination of the charging roller by forming a nip between the charging roller and a cleaning roller formed of a foamed roller and cleaning the charging roller with the cleaning roller. However, if the cleaning roller or the charging roller is permanently deformed by pressure imposed thereon by the nip formation, abnormal charging will occur to have adverse effects on an image to be formed. Therefore, a technique is proposed in which the rollers to be placed under pressure during nip formation are moved away from each other to release them from the pressure and thus avoid their permanent deformation.

SUMMARY

A technique improved over the above technique is proposed as one aspect of the present disclosure.

An image forming unit according to an aspect of the present disclosure includes a first process roller, a second process roller, a bush member, and a shifting mechanism.

The first process roller is configured to form a nip with an object.

The second process roller is provided to be capable of forming a nip with the first process roller.

The bush member includes a first journal portion journaling the first process roller and a second journal portion journaling the second process roller with the first process roller rested on the second process roller.

The shifting mechanism is configured to move the bush member in a direction of abutment and separation in which the first process roller journaled by the first journal portion abuts against and separates from the object.

Furthermore, the first journal portion and the second journal portion are juxtaposed in the direction of abutment and separation.

The first journal portion includes an escape shaped portion allowing the first process roller to shift in the direction of abutment and separation within the first journal portion and is configured to, when the first process roller is free from nip with the object, journal the first process roller with play in the direction of abutment and separation provided by the escape shaped portion.

The first journal portion is configured to, when the first process roller forms a nip with the object by the movement of the bush member actuated by the shifting mechanism, journal the first process roller so that the first process roller is pressed by the object to shift to a position within the first journal portion close to the second process roller.

An image forming apparatus according to another aspect of the present disclosure includes the aforementioned image forming unit and a fixing section configured to fix a toner image, which has been transferred directly or indirectly to a recording medium by the image forming unit, on the recording medium.

DETAILED DESCRIPTION

Hereinafter, a description will be given of image forming units according to embodiments of the present disclosure and image forming apparatuses with the same with reference to the drawings.

Embodiment 1

Figure 1:
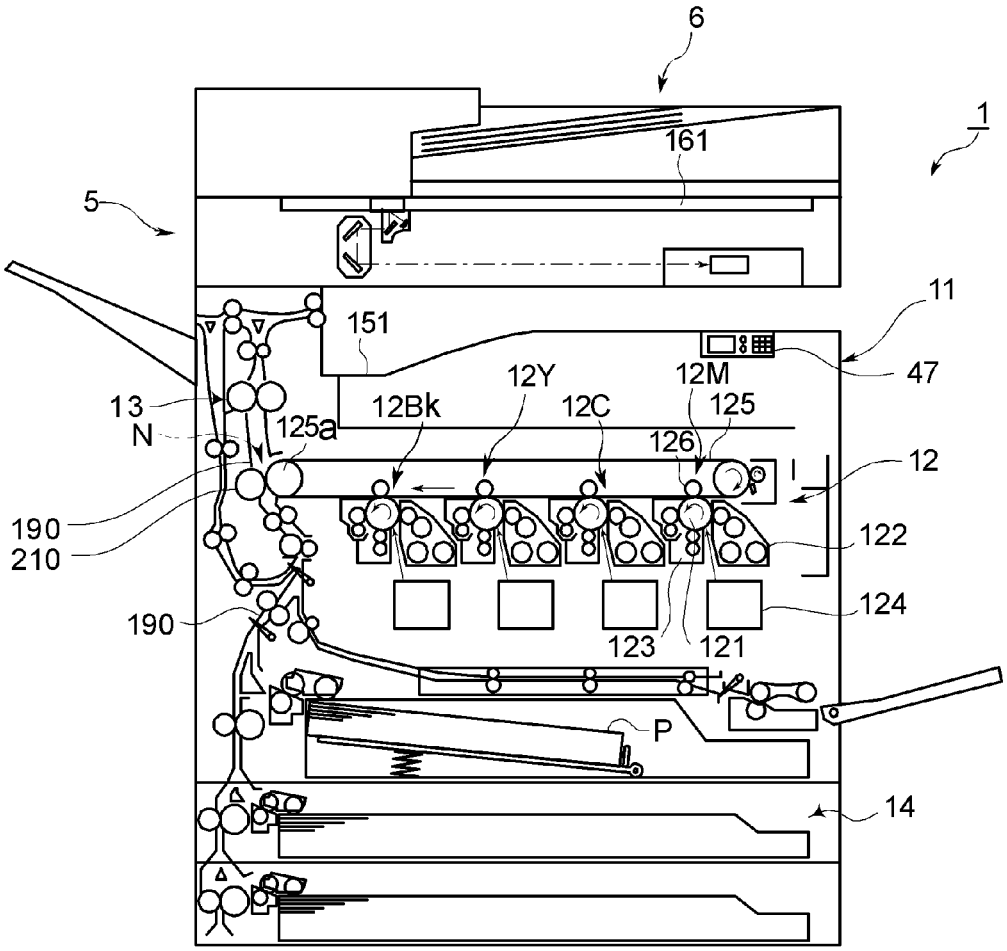
FIG. 1 is a front cross-sectional view showing the structure of an image forming apparatus including an image forming unit according to one embodiment of the present disclosure.

FIG. 1 is a front cross-sectional view showing the structure of an image forming apparatus including an image forming unit according to one embodiment of the present disclosure. The image forming apparatus 1 according to the one embodiment of the present disclosure is a multifunction peripheral having multiple functions including, for example, a copy function, a print function, a scan function, and a facsimile function. The image forming apparatus 1 is made up so that an apparatus body 11 thereof includes an operating section 47, an image forming section 12 (image forming unit), a fixing section 13, a paper feed section 14, a document feed section 6, a document reading section 5, and so on.

In a document reading operation of the image forming apparatus 1, the document reading section 5 optically reads an image of an original document being fed from the document feed section 6 or an image of an original document placed on an original glass plate 161 to generate image data. The image data generated by the document reading section 5 is stored on an internal HDD, a network-connected computer or the like.

In an image forming operation of the image forming apparatus 1, the image forming section 12 forms a toner image on a recording paper sheet P serving as a recording medium fed from the paper feed section 14, based on image data generated by the document reading operation, image data stored on the internal HDD or like image data. Each of image forming units 12M, 12C, 12Y, and 12Bk constituting the image forming section 12 includes a photosensitive drum 121, a charging device 123, an exposure device 124, a developing device 122, and a primary transfer roller 126.

The developing device 122 of each of the image forming units 12M, 12C, 12Y, and 12Bk contains toner for developing an electrostatic latent image. The developing device 122 is configured to supply toner to the surface of the associated photosensitive drum 121 where charging of the charging device 123 and exposure of the exposure device 124 have been completed.

In the case of multicolor printing, the image forming unit 12M for magenta, the image forming unit 12C for cyan, the image forming unit 12Y for yellow, and the image forming unit 12Bk for black of the image forming section 12 form respective toner images on their respective photosensitive drums 121 through charging, exposure, and developing processes based on respective images of respective different color components constituting the above image data and then allow their respective primary transfer rollers 126 to transfer the toner images to an intermediate transfer belt 125 mounted over a drive roller 125*a* and a driven roller.

The outer peripheral surface of the intermediate transfer belt 125 is set to an image carrying surface to which toner images are to be transferred. The intermediate transfer belt 125 is driven by the drive roller 125*a* while abutting against the peripheral surfaces of the photosensitive drums 121. The intermediate transfer belt 125 endlessly travels between the drive roller 125*a* and the driven roller while synchronizing with the rotation of each photosensitive drum 121.

The toner images of different colors transferred to the intermediate transfer belt 125 are superposed each other on the intermediate transfer belt 125 by controlling their transfer timings, resulting in a multicolor toner image. A secondary transfer roller 210 transfers the multicolor toner image formed on the outer peripheral surface of the intermediate transfer belt 125, at a nip N formed by the secondary transfer roller 210 and the drive roller 125*a* with the intermediate transfer belt 125 in between, to a recording paper sheet P conveyed from the paper feed section 14 along a conveyance path 190. Thereafter, the fixing section 13 fixes the toner image on the recording paper sheet P by the application of heat and pressure. The recording paper sheet P having a multicolor image fixed thereon by the completion of the fixing treatment is discharged to a paper output tray 151.

Next, a description will be given of the mechanisms of the photosensitive drum 121, the charging device 123, and surrounding components in each of the image forming units 12M, 12C, 12Y, and 12Bk. Note that the mechanisms of the photosensitive drum 121, the charging device 123, and surrounding components are common among the image forming units 12M, 12C, 12Y, and 12Bk and therefore the following description will be given without specifying the image forming unit for which color is referred to.

Figure 2:
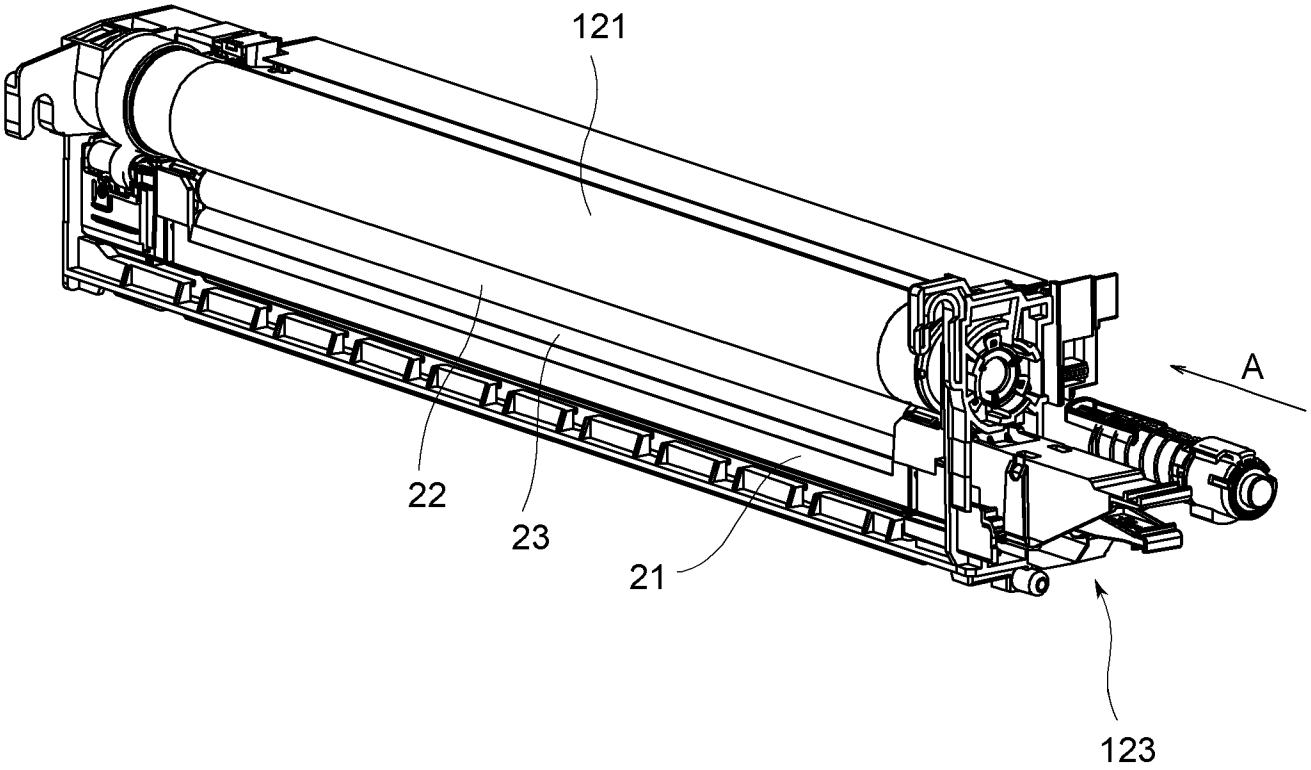
FIG. 2 is a perspective view showing the mechanisms of a photosensitive drum, a charging device, and surrounding components.
Figure 3:
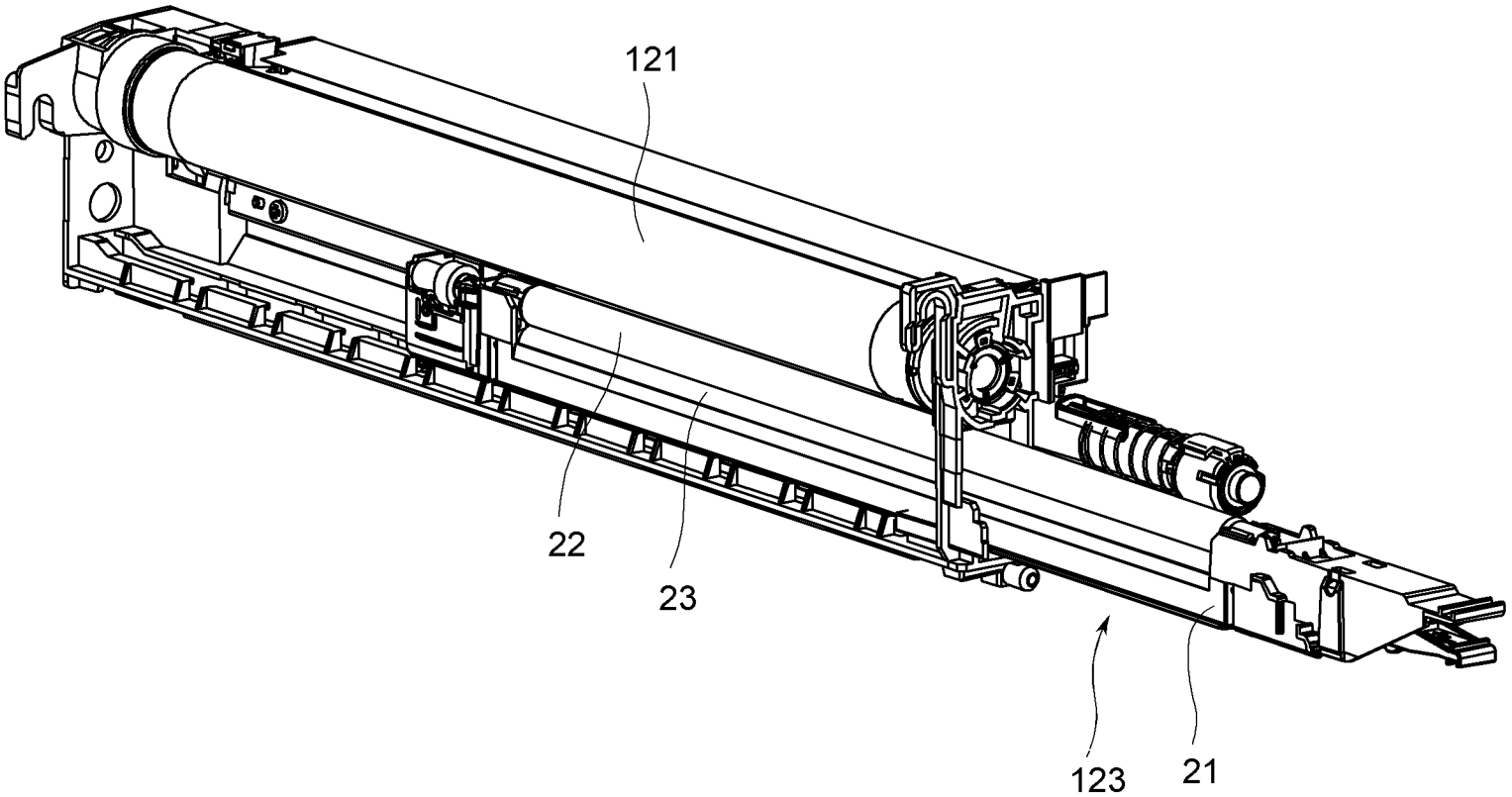
FIG. 3 is a perspective view showing the mechanisms of the photosensitive drum, the charging device, and the surrounding components and showing a state where the charging device is pulled outward.
Figure 4:
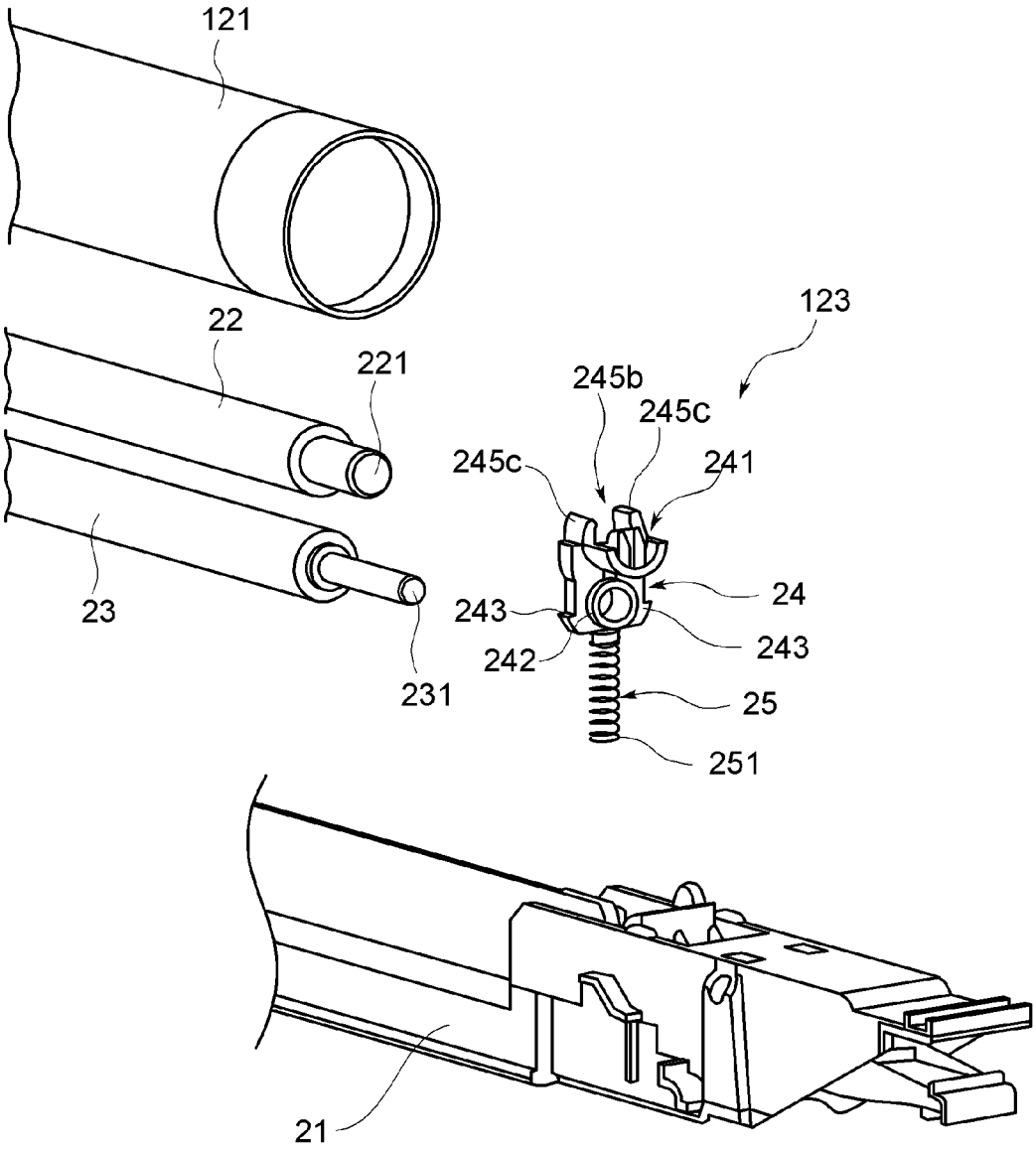
FIG. 4 is a perspective view showing the charging device from which the photosensitive drum, a charging roller, and a cleaning roller are uncoupled.

FIG. 2 is a perspective view showing the mechanisms of the photosensitive drum 121, the charging device 123, and surrounding components. FIG. 3 is a perspective view showing the mechanisms of the photosensitive drum 121, the charging device 123, and the surrounding components and showing a state where the charging device 123 is pulled outward. FIG. 4 is a perspective view showing the charging device 123 from which the photosensitive drum 121, a charging roller 22, and a cleaning roller 23 are uncoupled.

In each image forming unit, the charging device 123 is disposed below the photosensitive drum 121. The charging device 123 includes a charging case 21, a charging roller 22, a cleaning roller 23, a bush member 24, and a shifting mechanism 25.

The charging case 21 is formed of a housing a surface of which facing the photosensitive drum 121 is open to the outside. The charging roller 22, the cleaning roller 23, the bush member 24, and the shifting mechanism 25 are disposed in the interior of the charging case 21.

The charging roller 22 (an example of the first process roller) is a roller configured to come into contact with the photosensitive drum 121 (an example of the object) and apply a charging bias to the drum surface to electrically charge the surface of the photosensitive drum 121. The charging roller 22 is formed of, for example, a conductive rubber layer in which an ionically conductive material is mixed into epichlorohydrin. The charging roller 22 is configured to be given a bias from an unshown charging bias applying section.

The cleaning roller 23 (an example of the second process roller) is a roller configured to clean the charging roller 22. The cleaning roller 23 is, for example, a sponge (foamed) roller. The cleaning roller 23 is disposed to be abuttable against the charging roller 22 and configured to remove stains deposited on the peripheral surface of the charging roller 22, for example, in a manner that its peripheral surface rotates with a difference in circumferential speed from the peripheral surface of the charging roller 22 and in the same direction of rotation as that of the charging roller 22.

As shown in FIG. 4, the rotary shafts of the photosensitive drum 121, the charging roller 22, and the cleaning roller 23 are aligned with each other in an imaginary line. The bush member 24 is a member configured to journal the charging roller 22 and the cleaning roller 23. The bush member 24 includes a first journal portion 241 rotatably journaling the rotary shaft 221 of the charging roller 22 and a second journal portion 242 rotatably journaling the rotary shaft 231 of the cleaning roller 23.

The shifting mechanism 25 is mounted to a lower portion of the bush member 24. The shifting mechanism 25 includes a biasing spring 251 and a guide portion 26 to be described hereinafter. The biasing spring 251 is configured to urge the bush member 24 journaling the charging roller 22 and the cleaning roller 23 upward from below in FIG. 4, i.e., in a direction in which the charging roller 22 moves toward the photosensitive drum 121. On the other hand, when a pressure is applied to the charging roller 22 downward from above in FIG. 4, i.e., in a direction away from the photosensitive drum 121, the biasing spring 251 contracts to allow the bush member 24 to move downward in FIG. 4. In this manner, the biasing spring 251 can move the bush member 24 in a direction of abutment and separation in which the charging roller 22 abuts against and separates from the photosensitive drum 121.

The charging case 21 contains the bush member 24 with the first journal portion 241 and the second journal portion 242 journaling the charging roller 22 and the cleaning roller 23, respectively.

Figure 5B:
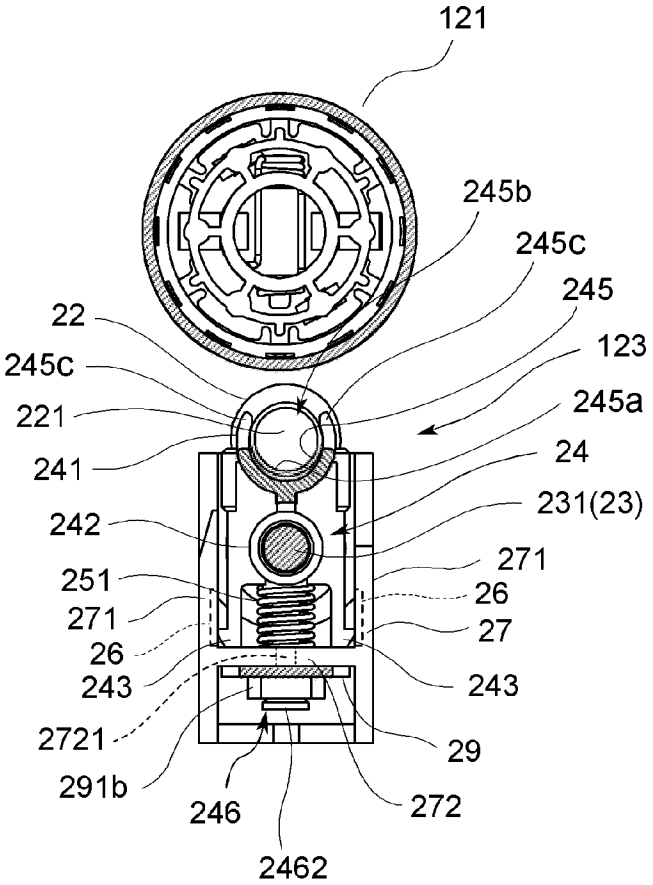
FIG. 5B is a side cross-sectional view of the photosensitive drum and the charging device as viewed from the direction of the arrow A in FIG. 2 when the charging roller is separated from the surface of the photosensitive drum.
Figure 5A:
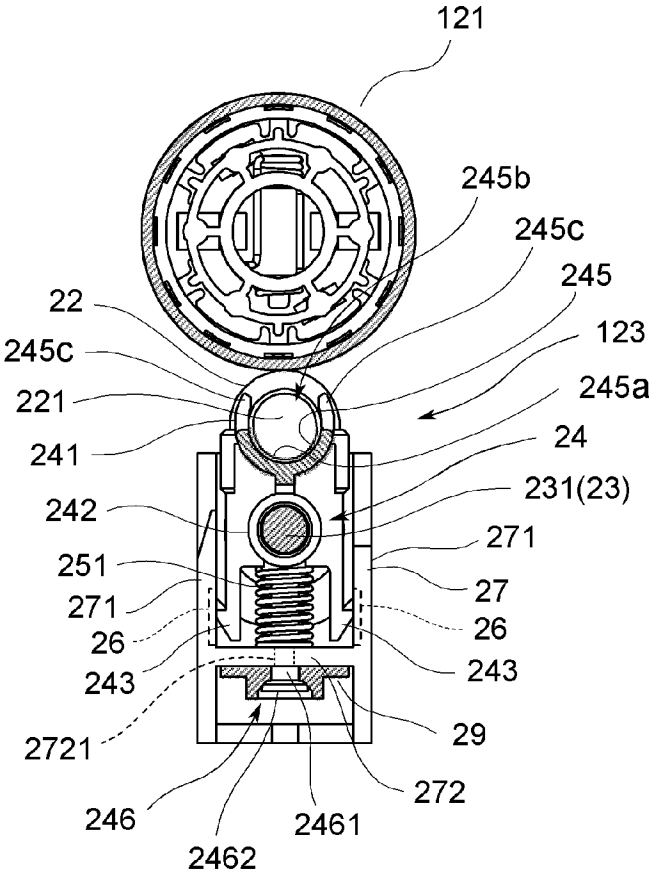
FIG. 5A is a side cross-sectional view of the photosensitive drum and the charging device as viewed from the direction of the arrow A in FIG. 2 when the charging roller forms a nip with the surface of the photosensitive drum.

Next, a description will be given of a mechanism for switching the charging roller 22 between the establishment of a nip with the photosensitive drum 121 and the release from the nip through the movement of the bush member 24. FIGS. 5A and 5B are side cross-sectional views of the photosensitive drum 121 and the charging device 123 as viewed from the direction of the arrow A in FIG. 2. FIG. 5A shows a state where the charging roller 22 forms a nip with the surface of the photosensitive drum 121 and FIG. 5B shows a state where the charging roller 22 is separated from the surface of the photosensitive drum 121.

A support portion 27 supports the bush member 24. The charging case 21 of the charging device 123 includes the support portion 27 and a guide portion 26. The support portion 27 includes side portions 271 and a bottom portion 272 and is formed of part of the charging case 21.

The guide portion 26 is guide rails provided in the inside wall surfaces of the side portions 271 of the support portion 27. The guide rails serving as the guide portion 26 have respective slots extending in the direction of abutment and separation and capable of guiding the movement of the bush member 24 in the direction of abutment and separation. The slots are formed in portions of the charging case 21 facing respective projections 243 formed on both the lateral sides of the bush member 24. The guide portion 26 supports the projections 243 fitted in the slots so that the projections 243 can freely slide within the slots in the direction of abutment and separation.

The biasing spring 251 is mounted at one end to the lower portion of the bush member 24 and mounted at the other end to the bottom portion 272 of the support portion 27 facing the lower portion of the bush member 24. Thus, the biasing spring 251 can move the bush member 24 and thus both the charging roller 22 and cleaning roller 23, which are journaled by the bush member 24, along the slots in the direction toward the surface of the photosensitive drum 121 by its own urging force and move them in the direction away from the surface of the photosensitive drum 121 by contracting itself under external force resisting the urging force.

The first journal portion 241 of the bush member 24 has an escape shaped portion 245 allowing the charging roller 22 to shift in the direction of abutment and separation within the first journal portion 241. The escape shaped portion 245, as shown in FIGS. 5A and 5B, has the shape of an oval hole in which the diameter in the direction of abutment and separation is longer than the diameter perpendicular to the direction of abutment and separation. The diameter of the escape shaped portion 245 perpendicular to the direction of abutment and separation is equal to or slightly longer than that of the rotary shaft 221 of the charging roller 22. The escape shaped portion 245 has a bottom 245*a* formed in an arcuate shape conforming to the peripheral surface of the rotary shaft 221 of the charging roller 22 and has an opening 245*b* formed at the top to face the photosensitive drum 121. The first journal portion 241 journals the charging roller 22 with play in the direction of abutment and separation provided by the escape shaped portion 245. The escape shaped portion 245 guides the shift of the charging roller 22 in the direction of abutment and separation.

The first journal portion 241 includes a pair of shift restricting portions 245*c* configured to restrict the shift of the charging roller 22 in the direction of abutment and separation within the first journal portion 241 to a predetermined amount. The pair of shift restricting portions 245*c* are formed by extending the lateral edges of the opening 245*b* close to the photosensitive drum 121 in directions to reduce the diameter of the oval hole (inwardly). Thus, when the charging roller 22 shifts toward the photosensitive drum 121 and moves to a position where it engages against the shift restricting portions 245*c*, the movement is restricted by the interference of the shift restricting portions 245*c*.

The charging roller 22 journaled by the first journal portion 241 is rested on the cleaning roller 23 journaled by the second journal portion 242. The distance between the first journal portion 241 and the second journal portion 242 is selected such that when the charging roller 22 is rested on the cleaning roller 23, the charging roller 22 is journaled by the first journal portion 241 with play. Therefore, when the charging roller 22 does not receive pressure from the photosensitive drum 121 in a direction away from the photosensitive drum 121, for example, when as shown in FIG. 5B the charging roller 22 is not pressed against the photosensitive drum 121 by the biasing spring 251 and the bush member 24, the charging roller 22 is simply rested on the cleaning roller 23 and does not form a nip in which the charging roller 22 presses against the cleaning roller 23. In this state, the rotary shaft 221 of the charging roller 22 is journaled with a clearance from the bottom 245*a* of the first journal portion 241 by the first journal portion 241.

The bush member 24 includes an engagement portion 246 (not shown in FIG. 4) provided at the lower portion thereof and extending toward the bottom portion 272. A portion of the bottom portion 272 facing the lower portion of the bush member 24 is provided with a receiving hole 2721 receiving the engagement portion 246 and allowing the engagement portion 246 to pass therethrough. The engagement portion 246 includes a root portion 2461, for example, in a columnar shape. The root portion 2461 passes through the receiving hole 2721 and projects below the bottom portion 272 regardless of whether the biasing spring 251 extends or contracts. However, the amount of projection of the root portion 2461 from the bottom portion 272 increases or decreases according to the amount of extension or contraction of the biasing spring 251. The engagement portion 246 further includes a distal end portion 2462 located downwardly of the root portion 2461 and close to the bottom portion 272. The distal end portion 2462 is formed in a disc shape having a larger diameter than the root portion 2461.

Disposed under the bottom portion 272 is a position restricting member 29 movable in a direction perpendicular to the direction of abutment and separation. The position restricting member 29 has a width substantially equal to the width of the bottom portion 272 and is attached to the support portion 27 slideably along the under surface of the bottom portion 272.

Figure 6B:
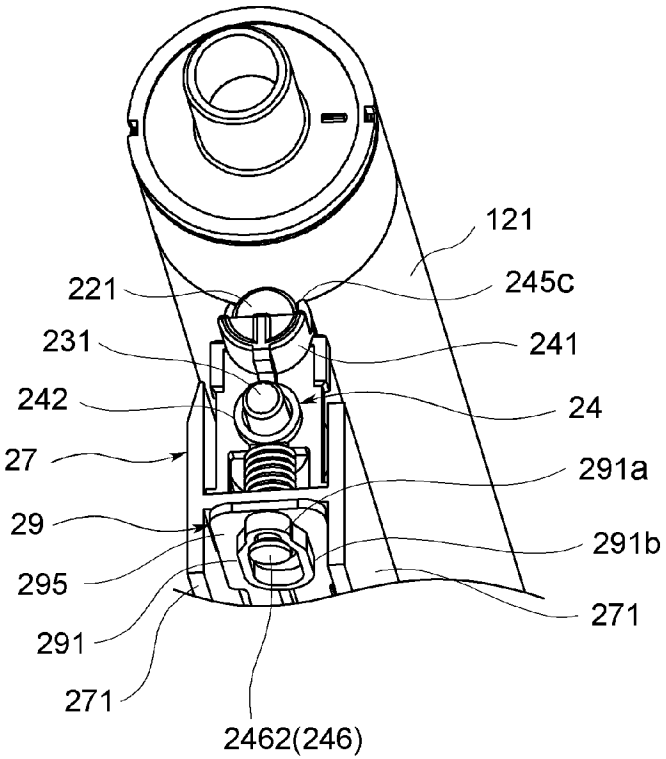
FIG. 6B is a perspective view of the photosensitive drum and the charging device as viewed from below in FIG. 2 when the charging roller is separated from the surface of the photosensitive drum.
Figure 6A:
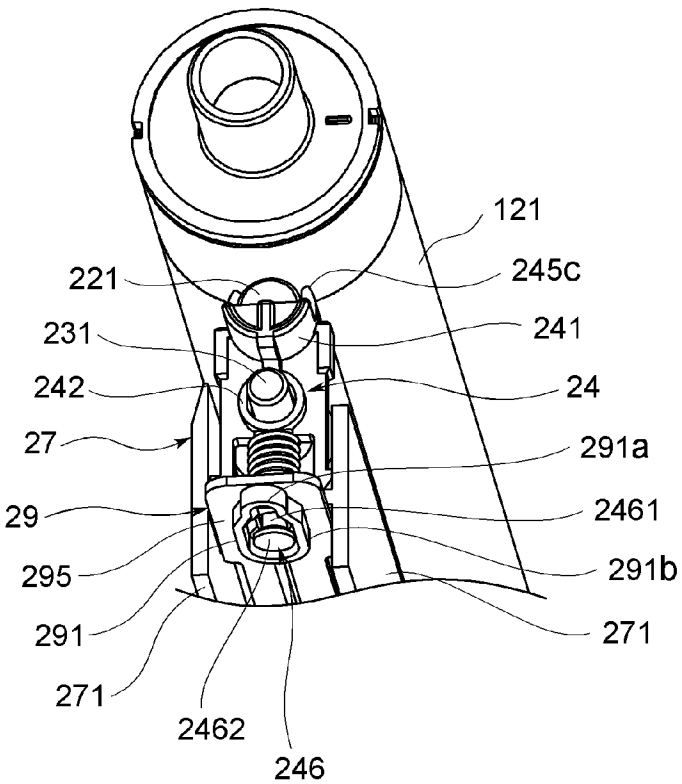
FIG. 6A is a perspective view of the photosensitive drum and the charging device as viewed from below in FIG. 2 when the charging roller forms a nip with the surface of the photosensitive drum.

FIGS. 6A and 6B are perspective views of the photosensitive drum 121 and the charging device 123 as viewed from below in FIG. 2. FIG. 6A shows a state where the charging roller 22 forms a nip with the surface of the photosensitive drum 121 and FIG. 6B shows a state where the charging roller 22 is separated from the surface of the photosensitive drum 121.

As shown in FIGS. 6A and 6B, the position restricting member 29 has a locking hole 291 formed in a portion raised from a bottom surface 295 of the position restricting member 29. The locking hole 291 is composed of: a first locking hole 291*a* having a width substantially equal to the diameter of the root portion 2461 of the engagement portion 246 and extending in the direction perpendicular to the direction of abutment and separation; and a second locking hole 291*b* having a width substantially equal to the diameter of the distal end portion 2462. The first locking hole 291*a* and the second locking hole 291*b* are integrally formed to form a single continuous locking hole 291. The height of the locking hole 291 in the direction of abutment and separation is selected at a dimension at which the biasing spring 251 can be contracted in the direction of abutment and separation enough to separate the charging roller 22 journaled by the first journal portion 241 from the photosensitive drum 121.

When, with the biasing spring 251 contracting in the direction of abutment and separation and the root portion 2461 of the engagement portion 246 of the bush member 24 projecting beyond the bottom portion 272, the position restricting member 29 is slid in the direction perpendicular to the direction of abutment and separation to a position where the first locking hole 291*a* locks with the distal end portion 2462, the position of the bush member 24 in the direction of abutment and separation can be held, by the above locking, at a position where the charging roller 22 is separated from the photosensitive drum 121.

On the other hand, when the position restricting member 29 is slid in the direction perpendicular to the direction of abutment and separation to a position where the second locking hole 291*b* coincides with both the root portion 2461 and the distal end portion 2462, the distal end portion 2462 is unlocked from the locking hole 291. Thus, the biasing spring 251 is released from constraint due to the locking and presses and moves the bush member 24 toward the photosensitive drum 121 in the direction of abutment and separation.

When, with the first locking hole 291*a* and the distal end portion 2462 unlocked from each other, the charging roller 22 journaled by the first journal portion 241 is moved toward the photosensitive drum 121 by the urge of the biasing spring 251, the charging roller 22 abuts against the photosensitive drum 121 and is restrained from further movement due to the urge upon and by abutment against the photosensitive drum 121. The urging force of the biasing spring 251 is determined at a value that allows the charging roller 22 to come into contact with the photosensitive drum 121 with a pressure equal to or greater than a predetermined urging force. Therefore, when the first locking hole 291*a* and the distal end portion 2462 are unlocked from each other, the charging roller 22 forms a nip with the photosensitive drum 121.

Next, a description will be given of situations where a switch between establishment and release of a nip of the charging roller 22 against the photosensitive drum 121 is made using the bush member 24, the shifting mechanism 25, the support portion 27, and the position restricting member 29 which have their respective configurations described above.

Before the shipment of the image forming apparatus 1, as shown in FIGS. 5B and 6B, the first locking hole 291*a* of the position restricting member 29 is moved to a position where it locks with the distal end portion 2462 of the engagement portion 246. Thus, through the contraction of the biasing spring 251, the bush member 24 keeps the charging roller 22, which is journaled by the first journal portion 241, separated from the photosensitive drum 121. By the separation, the charging roller 22 is kept free of a pressure from the photosensitive drum 121 as a reaction to the urging force of the biasing spring 251, i.e., a pressure to move it away from the photosensitive drum 121 in the direction of abutment and separation. Therefore, the charging roller 22 is held rested on the surface of the cleaning roller 23. At this time, no load other than the weight of the charging roller 22 is imposed on the cleaning roller 23, so that the cleaning roller 23 and the charging roller 22 do not establish a nip between them.

Then, when after the shipment the image forming apparatus 1 is put into operation at the installation site, as shown in FIGS. 5A and 6A, the position restricting member 29 is moved in the direction perpendicular to the direction of abutment and separation to a position where the second locking hole 291*b* coincides with the distal end portion 2462 of the engagement portion 246. Thus, the biasing spring 251 is released from the constraint on its urging force imposed by the position restricting member 29, so that the bush member 24 moves, through the urge of the biasing spring 251, the charging roller 22 journaled by the first journal portion 241 toward the photosensitive drum 121. As a result, the charging roller 22 presses against the photosensitive drum 121, so that both the members form a nip between them.

At this time, the charging roller 22 receives a pressure from the photosensitive drum 121 as a reaction to the urging force of the biasing spring 251, i.e., a pressure to move it away from the photosensitive drum 121 in the direction of abutment and separation. Therefore, the charging roller 22 not only forms a nip with the photosensitive drum 121 but also forms a nip with the cleaning roller 23.

As seen from the above, by locking the first locking hole 291*a* of the position restricting member 29 with the distal end portion 2462 of the engagement portion 246, both the nip between the charging roller 22 and the photosensitive drum 121 and the nip between the charging roller 22 and the cleaning roller 23 can be cancelled.

Furthermore, by unlocking the first locking hole 291*a* of the position restricting member 29 and the distal end portion 2462 of the engagement portion 246 from each other to allow the biasing spring 251 to urge the bush member 24 toward the photosensitive drum 121, both the nip between the charging roller 22 and the photosensitive drum 121 and the nip between the charging roller 22 and the cleaning roller 23 can be established.

In relation to this, as an example of a technique of moving the rollers to be subjected to pressure during nip formation away from each other to release them from the pressure and thus avoid their permanent deformation, a mechanism (Mechanism A) can be considered in which the charging roller pressed against the photosensitive drum is separated from the photosensitive drum. Furthermore, a mechanism (Mechanism B) can also be considered in which the transfer roller pressed against the photosensitive drum is separated from the photosensitive drum. Moreover, a mechanism (Mechanism C) can also be considered in which the backup roller operable to press the belt to be cleaned against the cleaning roller is moved away from a position where the belt is pressed against the cleaning roller.

However, in a general image forming apparatus including a charging roller and a cleaning roller, when the charging roller forms a nip with the photosensitive drum, another nip is concurrently formed between the charging roller and the cleaning roller. Therefore, to avoid deformation of the rollers due to the experience of pressure, it is necessary to cancel both the nip between the photosensitive drum and the charging roller and the nip between the charging roller and the cleaning roller to release the charging roller and the cleaning roller from both the nips. In this respect, since the aforementioned Mechanisms A, B, and C can only separate each relevant pair of rollers from each other to release them from the experience of pressure, it is difficult to, even using these mechanisms, release the charging roller and the cleaning roller from both the nips.

Unlike the above conventional techniques, in this embodiment, the bush member 24 is used to juxtapose the charging roller 22 and the cleaning roller 23 in the direction of abutment against and separation from the photosensitive drum 121 and the first journal portion 241 of the bush member 24 journals, with the charging roller 22 rested on the cleaning roller 23, the charging roller 22 with play in the direction of abutment and separation provided by the escape shaped portion 245. Therefore, when the charging roller 22 is free of pressure toward the cleaning roller 23 in the direction of abutment and separation, the charging roller 22 and the cleaning roller 23 are free of pressure from each other.

Then, when the bush member 24 is moved in the direction of abutment and separation by the shifting mechanism 25, so that the charging roller 22 forms a nip with the photosensitive drum 121, the charging roller 22 is subjected to pressure from the photosensitive drum 121 to shift to a position within the first journal portion 241 close to the cleaning roller 23. Therefore, when the charging roller 22 is subjected to pressure from the photosensitive drum 121 by a reaction to the urge of the biasing spring 251, the charging roller 22 forms nips with both the photosensitive drum 121 and the cleaning roller 23.

Hence, when the shifting mechanism 25 moves the bush member 24 in the direction of abutment and separation to switch the charging roller 22 and the photosensitive drum 121 from a nip relation to a non-nip relation, both the nip between the photosensitive drum 121 and the charging roller 22 and the nip between the charging roller 22 and the cleaning roller 23 are cancelled, so that both the charging roller 22 and the cleaning roller 23 can be released from pressure applied thereto.

Furthermore, with the configuration of this embodiment, the switch between the establishment of nips against the charging roller 22 and the cleaning roller 23 and the release from the nips can be achieved, without the need for any complicated mechanism, with a relatively simple mechanism.

Embodiment 2

Figure 7A:
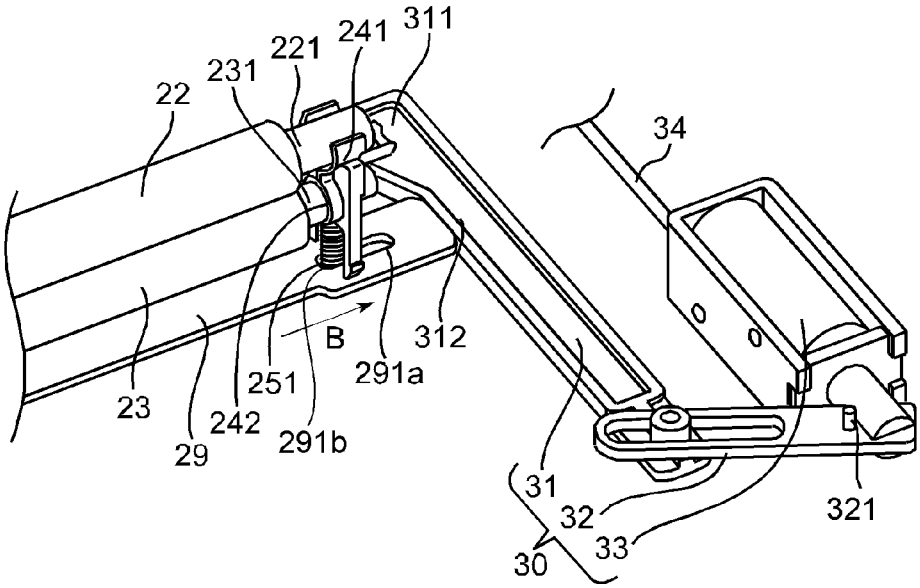
FIG. 7A is a view showing a drive mechanism operable to slide a position restricting member, wherein the charging roller forms a nip with the surface of the photosensitive drum.
Figure 7B:
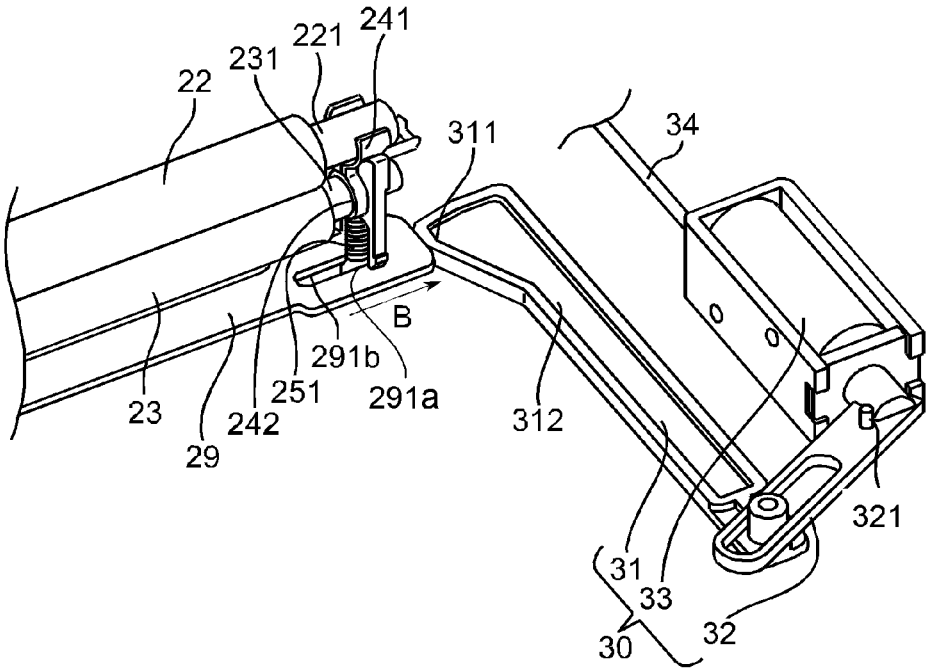
FIG. 7B is a view showing the drive mechanism operable to slide the position restricting member, wherein the charging roller is separated from the surface of the photosensitive drum.

In this embodiment, the image forming apparatus 1 further includes a drive mechanism configured to slide the position restricting member 29. FIGS. 7A and 7B are views showing the drive mechanism 30 configured to slide the position restricting member 29. FIG. 7A shows a state where the charging roller 22 forms a nip with the surface of the photosensitive drum 121 and FIG. 7B shows a state where the charging roller 22 is separated from the surface of the photosensitive drum 121. For convenience of description, the charging case 21 is not shown in FIG. 7.

The drive mechanism 30 includes a restricting wall 31 configured to restrict the movement of the position restricting member 29, a solenoid 33 operable depending upon the image forming operation of the image forming apparatus 1, and an arm 32 connected to one end of the restricting wall 31 and the solenoid 33.

The position restricting member 29 is always urged in a direction perpendicular to the direction of abutment and separation (the direction of the arrow B in FIG. 7) by an unshown biasing member. The restricting wall 31 is disposed ahead of the position restricting member 29 in the direction of the arrow B. This disposition of the restricting wall 31 restricts the movement of the position restricting member 29 in the direction of the arrow B. The restricting wall 31 is supported in the image forming unit 12 movably in a direction perpendicular to the direction of the arrow B.

The restricting wall 31 has, at different positions thereof in the direction perpendicular to the direction of the arrow B, different widths in the direction of the arrow B. As shown in FIG. 7B, while the position restricting member 29 abuts a wide portion 311 which is a portion of the restricting wall 31 having a large dimension in the direction of the arrow B, the distal end portion 2462 of the engagement portion 246 is locked by the first locking hole 291*a*. Therefore, in this state, the charging roller 22 is kept separated from the surface of the photosensitive drum 121.

On the other hand, as shown in FIG. 7A, while the position restricting member 29 abuts a narrow portion 312 which is a portion of the restricting wall 31 having a small dimension in the direction of the arrow B, the second locking hole 291*b* coincides with the root portion 2461 and the distal end portion 2462 and the distal end portion 2462 of the engagement portion 246 is unlocked from the first locking hole 291*a*. Therefore, in this state, the charging roller 22 forms a nip with the photosensitive drum 121.

Hence, by moving the restricting wall 31 in the direction perpendicular to the direction of the arrow B, switches can be made between a state where both the charging roller 22 and the cleaning roller 23 form nips and a state where both the charging roller 22 and the cleaning roller 23 are released from the nips.

As shown in FIGS. 6A and 6B, a slope capable of guiding the distal end portion 2462 of the engagement portion 246 therealong is provided between the first locking hole 291*a* and the second locking hole 291*b*. By the movement of the distal end portion 2462 of the engagement portion 246 along the slope, switches are made between a state where the distal end portion 2462 is locked by the first locking hole 291*a* and a state where the distal end portion 2462 is unlocked from the first locking hole 291*a*.

As shown in FIGS. 7A and 7B, one end of the restricting wall 31 is connected through the arm 32 to the solenoid 33. When the solenoid 33 operates, the arm 32 turns about a fulcrum pin 321, so that a force perpendicular to the direction of the arrow B is applied to the restricting wall 31. Thus, the restricting wall 31 moves in the direction perpendicular to the direction of the arrow B.

The solenoid 33 is connected to a wire 34 and configured to operate based on a signal transmitted through the wire 34. This signal is generated by a control section 100 (see FIG. 8)

to be described hereinafter. The solenoid 33 operates depending upon the image forming operation of the image forming apparatus 1.

Figure 8:
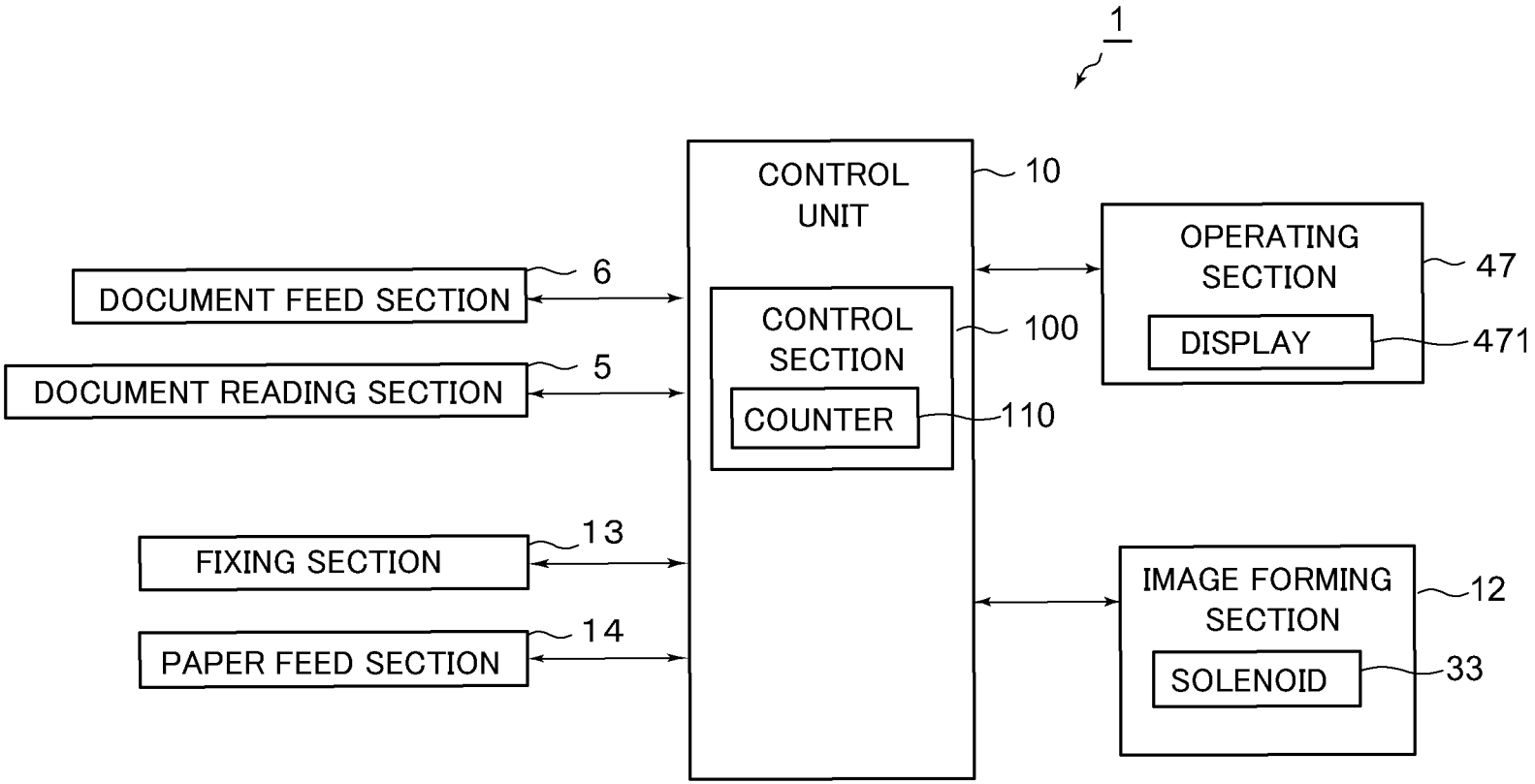
FIG. 8 is a functional block diagram schematically showing an essential internal configuration of the image forming apparatus.

Next, a description will be given of an electrical structure of the image forming apparatus 1. FIG. 8 is a functional block diagram schematically showing an essential internal configuration of the image forming apparatus 1.

The image forming apparatus 1 includes a control unit 10, a document reading section 5, a document feed section 6, an image forming section 12 (image forming unit), a fixing section 13, a paper feed section 14, an operating section 47, and so on.

The control unit 10 is composed of a CPU (central processing unit), a RAM, a ROM, a dedicated hardware circuit, and so on and governs the overall operation control of the image forming apparatus 1. The control unit 10 includes a control section 100. The control section 100 is connected to the document reading section 5, the document feed section 6, the image forming section 12, the fixing section 13, the paper feed section 14, the operating section 47, and so on and controls the operations of these components. In particular, the control section 100 generates, depending upon the image forming operation of the image forming apparatus 1, a signal for controlling the actuation of the solenoid 33 of the image forming section 12. The solenoid 33 operates based on this signal. Thus, the image forming apparatus 1 can switch, depending upon the image forming operation, between the state where both the charging roller 22 and the cleaning roller 23 of the image forming section 12 form nips and the state where both the charging roller 22 and the cleaning roller 23 are released from the nips. The control section 100 further includes a counter 110. The counter 110 counts a continuous time for which the image forming apparatus 1 does not perform the image forming operation.

The operating section 47 includes a touch panel section and an operating key section which are configured to receive user's commands for various types of operations and processing executable on the image forming apparatus 1. The touch panel section is provided on a display screen of a display 471, such as an LCD (liquid crystal display), provided in the operating section 47. The operator can use the operating section 47 to input, for example, a command to power on the image forming apparatus 1 or a command to power off the image forming apparatus 1.

Figure 9:
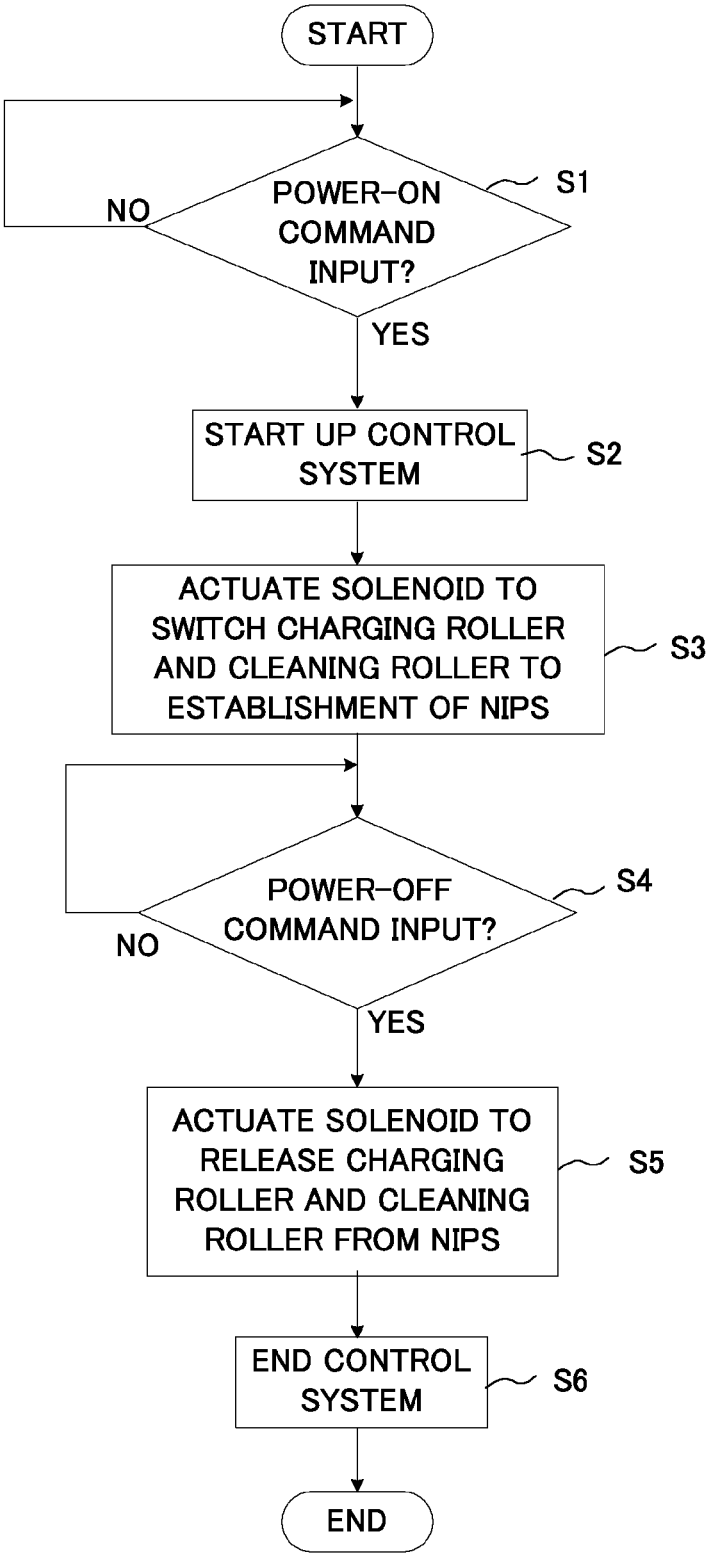
FIG. 9 is a flowchart showing an operation for switching between the establishment of nips against the charging roller and the cleaning roller and the release from the nips in the one embodiment of the present disclosure.

Next, a description will be given of an operation of the image forming apparatus 1 having the above configurations. FIG. 9 is a flowchart showing an operation for switching between the establishment of nips against the charging roller and the cleaning roller and the release from the nips.

When the image forming apparatus 1 is powered on (YES in step S1), the control section 100 starts up a control system for controlling the image forming operation and so on of the image forming apparatus 1 (step S2).

After the start-up of the control system, the control section 100 actuates the solenoid 33 to make a switch from the state where the charging roller 22 and the cleaning roller 23 of the image forming section 12 are released from nips to the state where the charging roller 22 and the cleaning roller 23 form nips (step S3).

Thereafter, the control section 100 monitors whether or not a command to power off the image forming apparatus 1 has been input through the operating section 47 (step S4). If a command to power off the image forming apparatus 1 has been input through the operating section 47 (YES in step S4), the control section 100 actuates the solenoid 33 to make a switch from the state where the charging roller 22 and the cleaning roller 23 of the image forming section 12 form nips to the state where the charging roller 22 and the cleaning roller 23 are released from the nips (step S5).

After the release from the nips, the control section 100 ends the control system for controlling the image forming operation of the image forming apparatus 1 (step S6).

In this manner, the control section 100 uses as triggers a command to power on the image forming apparatus 1 and a command to power off the image forming apparatus 1 to make switches between the establishment of nips against the charging roller 22 and the cleaning roller 23 and the release from the nips. During power-off in which the image forming operation is not performed, the charging roller 22 and the cleaning roller 23 are released from nips. Therefore, the charging roller 22 and the cleaning roller 23 can be prevented from being deformed by the experience of pressure.

The present disclosure is not limited to the configurations of the above embodiments and can be modified in various ways. A description will be given below of Modifications 1, 2, and 3 of the above embodiments.

<Modification 1>

In the above embodiments, a description has been given of the case where switches are made between the establishment of nips against the charging roller 22 and the cleaning roller 23 and the release from the nips by using as triggers a command to power on the image forming apparatus 1 and a command to power off the image forming apparatus 1. However, the present disclosure is not necessarily limited to this case. The present disclosure is sufficient if switches are made between the establishment of nips against the charging roller 22 and the cleaning roller 23 and the release from the nips depending upon the image forming operation of the image forming apparatus 1.

Figure 10:
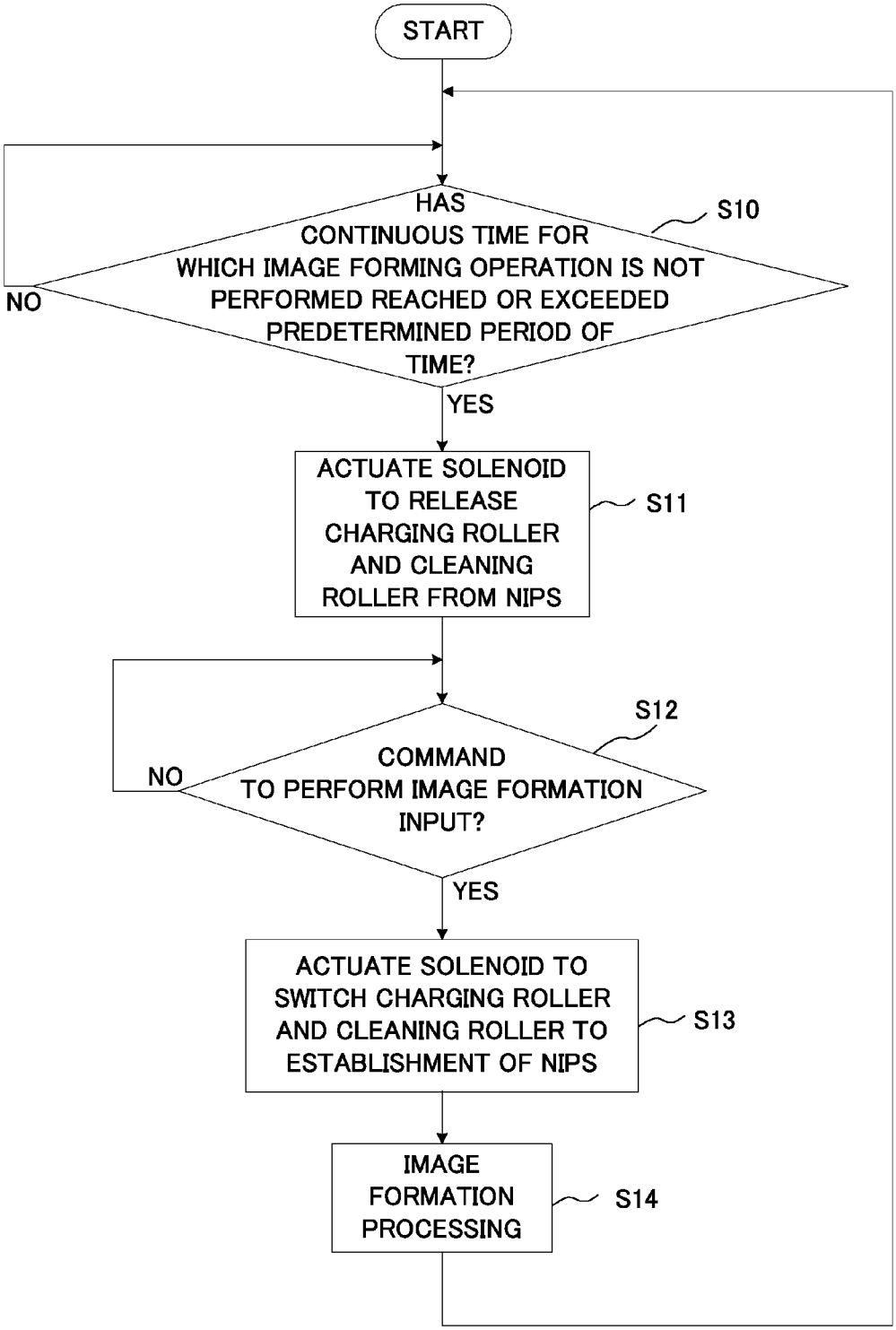
FIG. 10 is a flowchart showing an operation for switching between the establishment of nips against the charging roller and the cleaning roller and the release from the nips in Modification 1.

FIG. 10 is a flowchart showing an operation for switching between the establishment of nips against the charging roller and the cleaning roller and the release from the nips in Modification 1.

The counter 110 of the control section 100 counts a continuous time for which the image forming apparatus 1 does not perform the image forming operation (step S10). If the continuous time for which the image forming operation is not performed has reached or exceeded a predetermined period of time (YES in step S10), the control section 100 actuates the solenoid 33 to make a switch from the state where the charging roller 22 and the cleaning roller 23 of the image forming section 12 form nips to the state where the charging roller 22 and the cleaning roller 23 are released from the nips (step S11).

After the switch to the state of release from the nips, the control section 100 determines whether or not a command to perform an image formation has been input through the operating section 47 (step S12). If a command to perform an image forming operation has been input (YES in step S12), the control section 100 actuates the solenoid 33 to make a switch from the state where the charging roller 22 and the cleaning roller 23 of the image forming section 12 are released from nips to the state where the charging roller 22 and the cleaning roller 23 form nips (step S13). After the switch to the state of establishment of nips against the charging roller 22 and the cleaning roller 23, the control section 100 performs image formation processing (step S14).

When the image forming operation has not been performed over a predetermined period of time or longer as described above, the charging roller 22 and the cleaning roller 23 are released from nips. Therefore, the charging roller 22 and the cleaning roller 23 can be prevented from being deformed by the experience of pressure.

The control section 100 may release the charging roller 22 and the cleaning roller 23 from nips with a timing when the image forming apparatus 1 transitions to a mode (so-called power-saving mode) in which the standby power is lowered as compared to the normal mode.

<Modification 2>

In the above embodiments, the mechanism, provided in an apparatus having a plurality of nips among a plurality of rollers, for switching between a state where each roller pair forms a nip and a state where each roller pair is released from the nip has been described by taking as an example a mechanism for switching a pair of the photosensitive drum 121 and the charging roller 22 and a pair of the charging roller 22 and the cleaning roller 23 between the establishment of nips and the release from the nips. However, the mechanism is not limited to this example. The present disclosure is also applicable to switching other pairs of rollers between the establishment of nips and the release from the nips. Furthermore, the mechanism is also applicable to, besides the image forming apparatus 1, other apparatuses having a plurality of nips among a plurality of rollers.

<Modification 3>

In the above embodiments, a description has been given of the case where the rotary shafts of the photosensitive drum 121, the charging roller 22, and the cleaning roller 23 are aligned with each other in an imaginary line (see, for example, FIGS. 4 and 5). However, the present disclosure is not necessarily limited to this case.

Figure 11B:
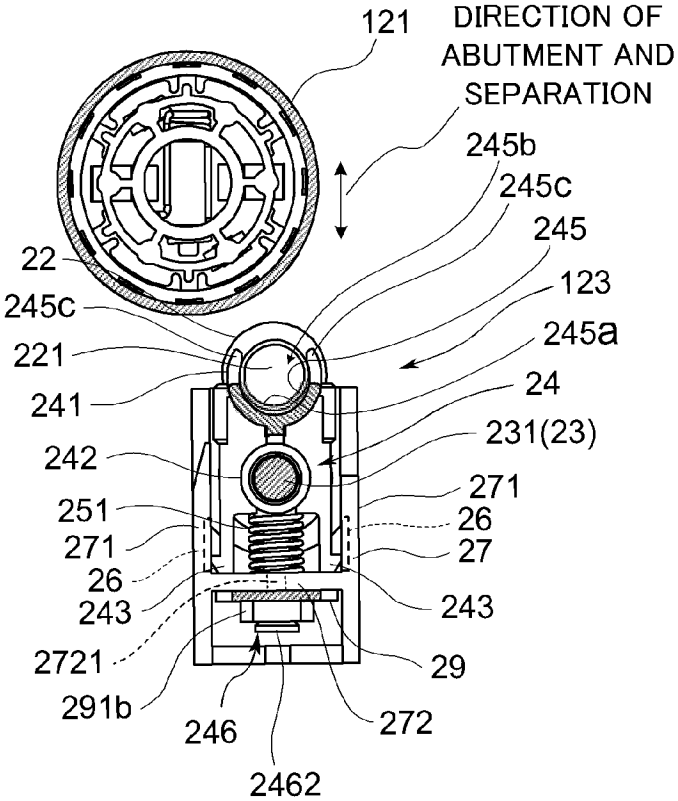
FIG. 11B is a side cross-sectional view of the photosensitive drum and the charging device as viewed from the direction of the arrow A in FIG. 2 when the charging roller in Modification 3 is separated from the surface of the photosensitive drum.
Figure 11A:
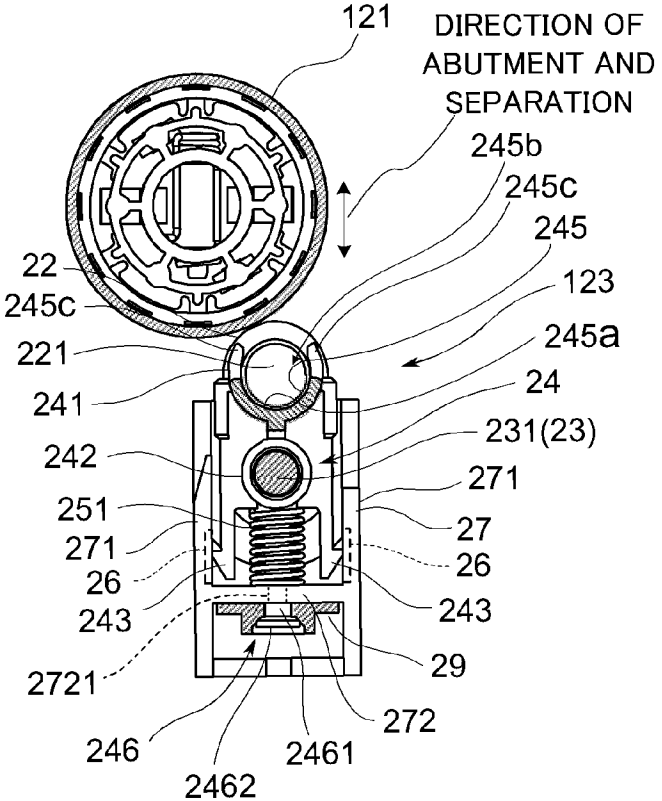
FIG. 11A is a side cross-sectional view of the photosensitive drum and the charging device as viewed from the direction of the arrow A in FIG. 2 when the charging roller in Modification 3 forms a nip with the surface of the photosensitive drum.

FIGS. 11A and 11B are side cross-sectional views of the photosensitive drum and the charging device in Modification 3 as viewed from the direction of the arrow A in FIG. 2. FIG. 11A shows a state where the charging roller 22 forms a nip with the surface of the photosensitive drum 121 and FIG. 11B shows a state where the charging roller 22 is separated from the surface of the photosensitive drum 121.

As shown in FIGS. 11A and 11B, in an example shown in Modification 3, the cylindrical shafts of the photosensitive drum 121, the charging roller 22, and the cleaning roller 23 are not aligned with each other in a common imaginary line. Yet, the first journal portion 241 journaling the charging roller 22 and the second journal portion 242 journaling the cleaning roller 23 are juxtaposed in the direction of abutment and separations like the above embodiments.

In the above embodiments and modifications, the "direction of abutment and separation" and the "direction in which the charging roller abuts against and separates from the photosensitive drum" refers to a direction in which the charging roller 22 changes from a state of separation from the photosensitive drum 121 to a state of abutment against the photosensitive drum 121 or a direction in which the charging roller 22 changes from the state of abutment against the photosensitive drum 121 to the state of separation from the photosensitive drum 121. In Modification 3 shown in FIGS. 11A and 11B, the "direction of abutment and separation" is an up-and-down direction of the paper plane.

As shown in FIG. 11B, when the charging roller 22 is free from nip with the photosensitive drum 121, the first journal portion 241 journals the charging roller 22 with play in the direction of abutment and separation provided by the escape shaped portion 245.

As shown in FIG. 11A, when the charging roller 22 forms a nip with the photosensitive drum 121, the first journal portion 241 journals the charging roller 22 so that the charging roller 22 is pressed by the photosensitive drum 121 to shift to a position within the first journal portion 241 close to the cleaning roller 23.

Therefore, also in the example shown in Modification 3, the same effects as in the above embodiments can be achieved.

The structures and processing shown in the above embodiments and modifications with reference to FIGS. 1 to 11B are merely illustrative of the present disclosure and the present disclosure is not intended to be limited to the above particular structures and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming unit comprising:

a first process roller configured to form a nip with an object;

a second process roller provided to be capable of forming a nip with the first process roller;

a bush member including a first journal portion journaling the first process roller and a second journal portion journaling the second process roller with the first process roller rested on the second process roller;

a shifting mechanism configured to move the bush member in a direction of abutment and separation in which the first process roller journaled by the first journal portion abuts against and separates from the object; and a drive mechanism configured to actuate the shifting mechanism depending upon an image forming operation, wherein the first journal portion and the second journal portion are juxtaposed in the direction of abutment and separation, the first journal portion includes an escape shaped portion allowing the first process roller to shift in the direction of abutment and separation within the first journal portion and is configured to, when the first process roller is free from nip with the object, journal the first process roller with play in the direction of abutment and separation provided by the escape shaped portion, the first journal portion is configured to, when the first process roller forms a nip with the object by the movement of the bush member actuated by the shifting mechanism, journal the first process roller so that the first process roller is pressed by the object to shift to a position within the first journal portion close to the second process roller, the shifting mechanism includes a support portion supporting the bush member, a biasing member urging the bush member toward the object in the direction of abutment and separation, and a guide portion provided laterally of the bush member contained in the support portion and configured to guide movement of the bush member in the direction of abutment and separation urged by the biasing member, the bush member includes an engagement portion extending toward a bottom portion of the support portion facing the bush member and the guide portion is provided with a receiving hole receiving the engagement portion and allowing the engagement portion to pass therethrough, the engagement portion projects beyond the guide portion to have different amounts of projection between when the first process roller is free from nip with the object and when the first process roller forms a nip with the object, the image forming unit further comprises a position restricting member movable in a direction perpendicular to the direction of abutment and separation between a locking position with respect to the engagement portion projecting beyond the guide portion when the first process roller is free from nip with the object and an unlocking position with respect to the engagement portion, and the drive mechanism is configured to move the position restricting member between the locking position and the unlocking position.

2. The image forming unit according to claim 1, wherein the first journal portion further includes a shift restricting portion configured to restrict the shift of the first process roller toward the object in the direction of abutment and separation to a predetermined amount.

3. The image forming unit according to claim 2, wherein the first journal portion includes as the escape shaped portion an oval hole extending in the direction of abutment and separation and configured to guide the shift of the first process roller and the shift restricting portion is formed by extending an end portion of the oval hole close to the object in a direction to reduce the diameter of the oval hole.

4. The image forming unit according to claim 1, wherein the position restricting member is urged in the direction perpendicular to the direction of abutment and separation, the drive mechanism includes a solenoid operable depending upon the image forming operation and a restricting wall configured to restrict the movement of the position restricting member in the direction of the urge, the restricting wall has, at different positions thereof in a direction perpendicular to the direction of the urge, different widths in the direction of the urge and is movable in the direction perpendicular to the direction of the urge by the operation of the solenoid, and the position restricting member is moved between the locking position and the unlocking position by the movement of the restricting wall in the direction perpendicular to the direction of the urge.

5. The image forming unit according to claim 1, wherein the drive mechanism is configured to actuate the shifting mechanism to, upon power-on of the image forming apparatus, shift the first process roller to a position where the first process roller forms a nip with the object and, upon power-off of the image forming apparatus, shift the first process roller to a position where the first process roller is free from nip with the object.

6. The image forming unit according to claim 1, wherein the drive mechanism is configured to, when the image forming operation has not been performed over a predetermined period of time or longer, shift the first process roller to the position where the first process roller is free from nip with the object.

7. The image forming unit according to claim 1, wherein the object is a photosensitive drum, the first process roller is a charging roller capable of coming into contact with a surface of the photosensitive drum to charge the surface, the second process roller is a cleaning roller configured to clean the charging roller, and the image forming unit further comprises:

an exposure section configured to expose the surface of the photosensitive drum charged by the charging roller to light to form an electrostatic latent image;

a developing section configured to supply toner to the electrostatic latent image formed by the exposure section to form a toner image; and a transfer section configured to transfer the toner image formed by the developing section to a recording medium or an intermediate transfer belt.

8. An image forming apparatus comprising an image forming unit and a fixing section configured to fix a toner image, which has been transferred directly or indirectly to a recording medium by the image forming unit, on the recording medium, wherein the image forming unit comprises:

a first process roller configured to form a nip with an object;

a second process roller provided to be capable of forming a nip with the first process roller;

a bush member including a first journal portion journaling the first process roller and a second journal portion journaling the second process roller with the first process roller rested on the second process roller;

a shifting mechanism configured to move the bush member in a direction of abutment and separation in which the first process roller journaled by the first journal portion abuts against and separates from the object; and a drive mechanism configured to actuate the shifting mechanism depending upon an image forming operation, the first journal portion and the second journal portion are juxtaposed in the direction of abutment and separation, the first journal portion includes an escape shaped portion allowing the first process roller to shift in the direction of abutment and separation within the first journal portion and is configured to, when the first process roller is free from nip with the object, journal the first process roller with play in the direction of abutment and separation provided by the escape shaped portion, the first journal portion is configured to, when the first process roller forms a nip with the object by the movement of the bush member actuated by the shifting mechanism, journal the first process roller so that the first process roller is pressed by the object to shift to a position within the first journal portion close to the second process roller, the shifting mechanism includes a support portion supporting the bush member, a biasing member urging the bush member toward the object in the direction of abutment and separation, and a guide portion provided laterally of the bush member contained in the support portion and configured to guide movement of the bush member in the direction of abutment and separation urged by the biasing member, the bush member includes an engagement portion extending toward a bottom portion of the support portion facing the bush member and the guide portion is provided with a receiving hole receiving the engagement portion and allowing the engagement portion to pass therethrough, the engagement portion projects beyond the guide portion to have different amounts of projection between when the first process roller is free from nip with the object and when the first process roller forms a nip with the object, the image forming unit further comprises a position restricting member movable in a direction perpendicular to the direction of abutment and separation between a locking position with respect to the engagement portion projecting beyond the guide portion when the first process roller is free from nip with the object and an unlocking position with respect to the engagement portion, and the drive mechanism is configured to move the position restricting member between the locking position and the unlocking position.

* * * * *